United States Patent [19]

Bickoff

[11] Patent Number: 4,964,832

[45] Date of Patent: Oct. 23, 1990

[54] MODULAR PUPPET SYSTEM

[76] Inventor: Charles Bickoff, 7 St. Andrews Dr., Avon, Conn. 06001

[21] Appl. No.: 385,827

[22] Filed: Jul. 27, 1989

[51] Int. Cl.[5] ..... A63H 3/16; A63H 3/14; A63H 3/02

[52] U.S. Cl. ..... 446/100; 446/329; 446/372; 446/901; 24/306; 24/442

[58] Field of Search ..... 446/100, 101, 99, 329, 446/328, 327, 372, 367, 366, 360, 359, 901, 362; 24/306, 442, 443, 444, 576, 587; 273/DIG. 30; 128/DIG. 15

[56] References Cited

U.S. PATENT DOCUMENTS

| | | | |
|---|---|---|---|
| 932,428 | 8/1909 | Beal et al. | 446/360 |
| 2,202,677 | 5/1940 | Usinskis | 446/362 |
| 3,686,718 | 8/1972 | Brumlik | 24/306 X |
| 3,703,739 | 11/1972 | Young et al. | 24/442 X |
| 3,742,644 | 7/1973 | Williams | 24/306 X |
| 3,789,547 | 2/1974 | Chemarin | 446/369 |
| 3,851,357 | 12/1974 | Ribich et al. | 24/306 |
| 3,854,239 | 12/1974 | Williams | 446/366 |
| 4,012,544 | 3/1977 | Richards | 24/306 X |
| 4,054,006 | 10/1977 | Estlund | 446/329 |
| 4,208,832 | 6/1980 | Corriveau | 446/369 X |
| 4,504,240 | 3/1985 | Thomas | 446/327 X |

FOREIGN PATENT DOCUMENTS

| | | | |
|---|---|---|---|
| 2202834 | 7/1973 | Fed. Rep. of Germany | 446/329 |
| 2342640 | 3/1975 | Fed. Rep. of Germany | 446/362 |
| 2519674 | 11/1975 | Fed. Rep. of Germany | 24/442 |
| 1789 | of 1911 | United Kingdom | 446/329 |
| 2082925 | 3/1982 | United Kingdom | 446/901 |

*Primary Examiner*—Robert A. Hafer
*Assistant Examiner*—D. Neal Muir

[57] ABSTRACT

This invention relates to the design of a modular puppet construction system which allows the user to achieve a broadly variable configuration, thereby permitting the user to add and remove modular body parts, features, clothing, other articles of usage, and control elements. The body and attachable parts may preferably be fabricated from a loop type material. The attachable parts and control elements may have hook type material permanently affixed to allow universal placement on the loop fabricated elements. The hook type material may also advantageously be a free standing part in a back to back configuration and used as an intermediate element to attach two loop fabricated parts. Additionally, elements not fabricated from loop or hook type materials may be affixed to the loop or hook type material to facilitate use. Moreover, the attachment interface may be in the form of an articulating or hingeable device which is surfaced with hook "VELCRO"-like material which when positioned between two physical elements of the puppet allow many degrees of movement or control of the attached modular parts. Additionally, the hook or loop type fastener may be affixed to control elements such as push rods and string controls to allow the fastening of such control elements to the modular puppet assembly. This modular arrangement thereby allows the toy to be configured as or converted between a stuffed toy, simple and advanced form of hand puppet, and a marionette.

8 Claims, 10 Drawing Sheets

MODULAR PUPPET SYSTEM

BACKGROUND OF THE INVENTION

The present invention came about as a recognition that, in creative play, children and adults often engage in role playing. Prior art puppets, dolls, and stuffed toys often represent a fixed character which requires changes to be either wholly imagined or considerable effort to be expended to change the visual, physical, and operational characteristics. This applies to all types of puppets, dolls, and stuffed toys, including the various forms of hand puppets and marionettes.

Many puppets and dolls exist that allow the user to reconfigure them through changes of clothing or the addition of accessories. Some even allow the change of some facial feature elements. However, none has provided the ability to totally configure every aspect of the character including features, limbs, accessories, clothing and control elements. Additionally, this arrangement allows conversion between doll, hand puppet, and marionette through the addition of control elements to further enhance the role playing and educational characteristics.

Bearing in mind, these and other deficiencies in the prior art, it is therefore an object of this invention to provide the individual engaged in creative play with a means to universally configure a puppet character and related control elements to meet the users role playing requirements.

An equally important purpose is to allow the user to easily reconfigure the puppet in a non-destructive manner for further creative play through the provision of modular items attachable to the base body and each other.

It is a further object of the present invention to construct the puppet out of materials that allow the various parts to adhere to one another when in use and be separated easily and non-destructively.

A further purpose is to provide a universal intermediate connection means of attachment to affix various elements to one another. One such means is the use of an intermediate fastener constructed of a hook type material permanently fastened in a back configuration.

It is a further object to provide parts such as cheeks, nose, eyes, hair, arms, legs, clothing, and accessories with loop or hook type material permanently attached to the part so that it may be easily located and attached anywhere on the body and head which is fabricated from the opposing loop or hook type materials or to another receptive part.

It is a further object of the present invention to provide an articulating and hingeable interfacing attachment means that will allow a high degree of mobility between the interfacing parts.

It is a further object to provide control elements such as strings, rods and other such elements as may be obvious to those skilled in the art which attach to either the articulate or hingeable items or are affixed directly to the surface of the element under control to facilitate movement or support.

SUMMARY OF THE INVENTION

The present invention relates to a puppet system which can be converted from one character to another and one type of puppet or doll to another more complex type. The character and type conversion is accomplished by attaching or non-destructively removing various body parts, accessories, clothing, and control elements together in a non-permanent fashion so that the user may create and modify their own characters and mode of use through the addition or deletion of these elements. The basic hand puppet may be converted to a push rod control type hand puppet through the addition of control rods that are affixed to the desired part by a "VELCRO"-like interfacing surface. Additionally, strings may be attached in a similar manner to convert the basic puppet to a marionette. Additionally, various hybrid arrangements are possible.

DETAILED DESCRIPTION OF THE INVENTION

While the present invention is especially useful in constructing a hand puppet or marionette; it will be understood by those skilled in the art that the techniques and modular attachment means herein taught can also be used to create modular stuffed toys of variable configuration.

Figure 1:
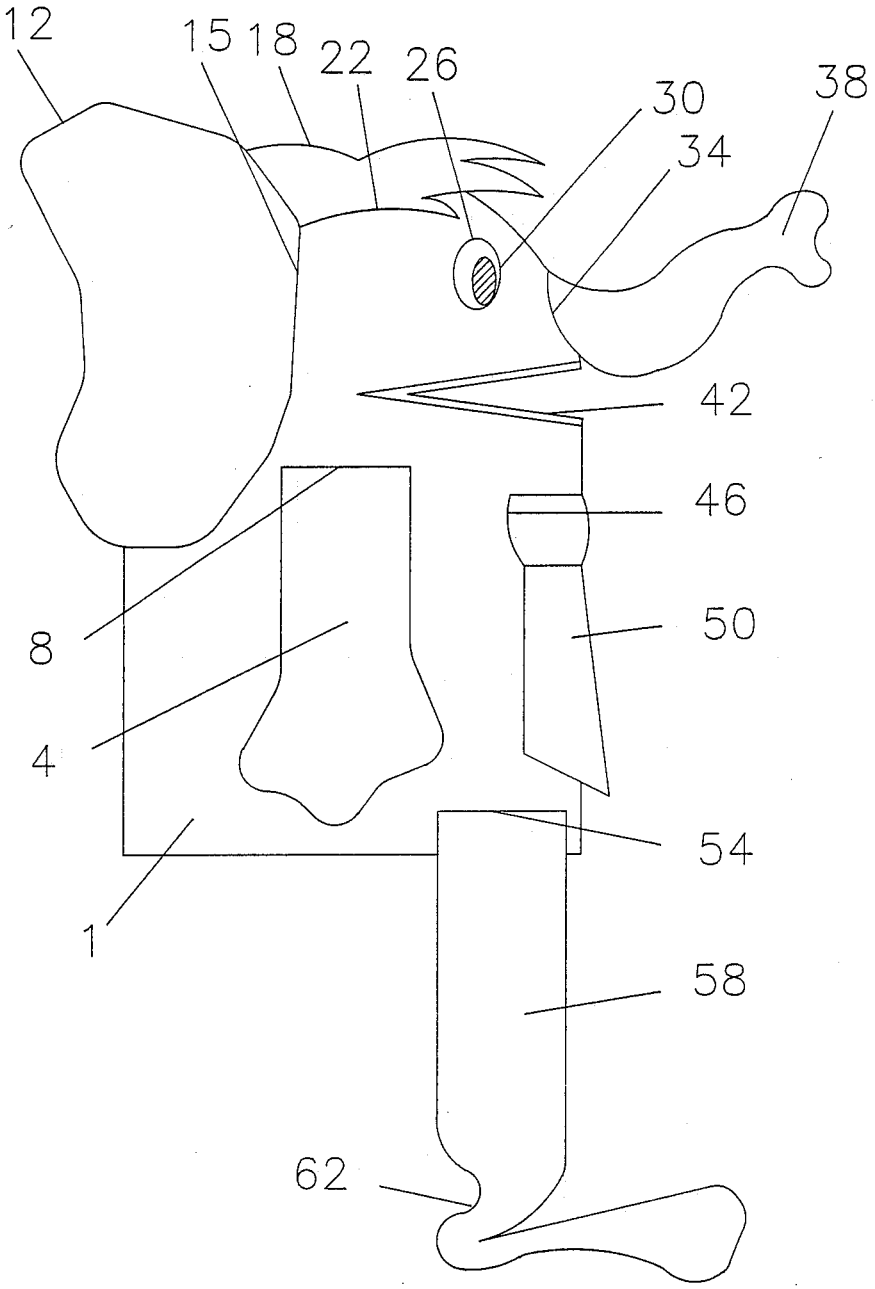
FIG. 1 illustrates a side view of the preferred embodiment of the present invention with typical parts attached in the hand puppet configuration.
Figure 2:
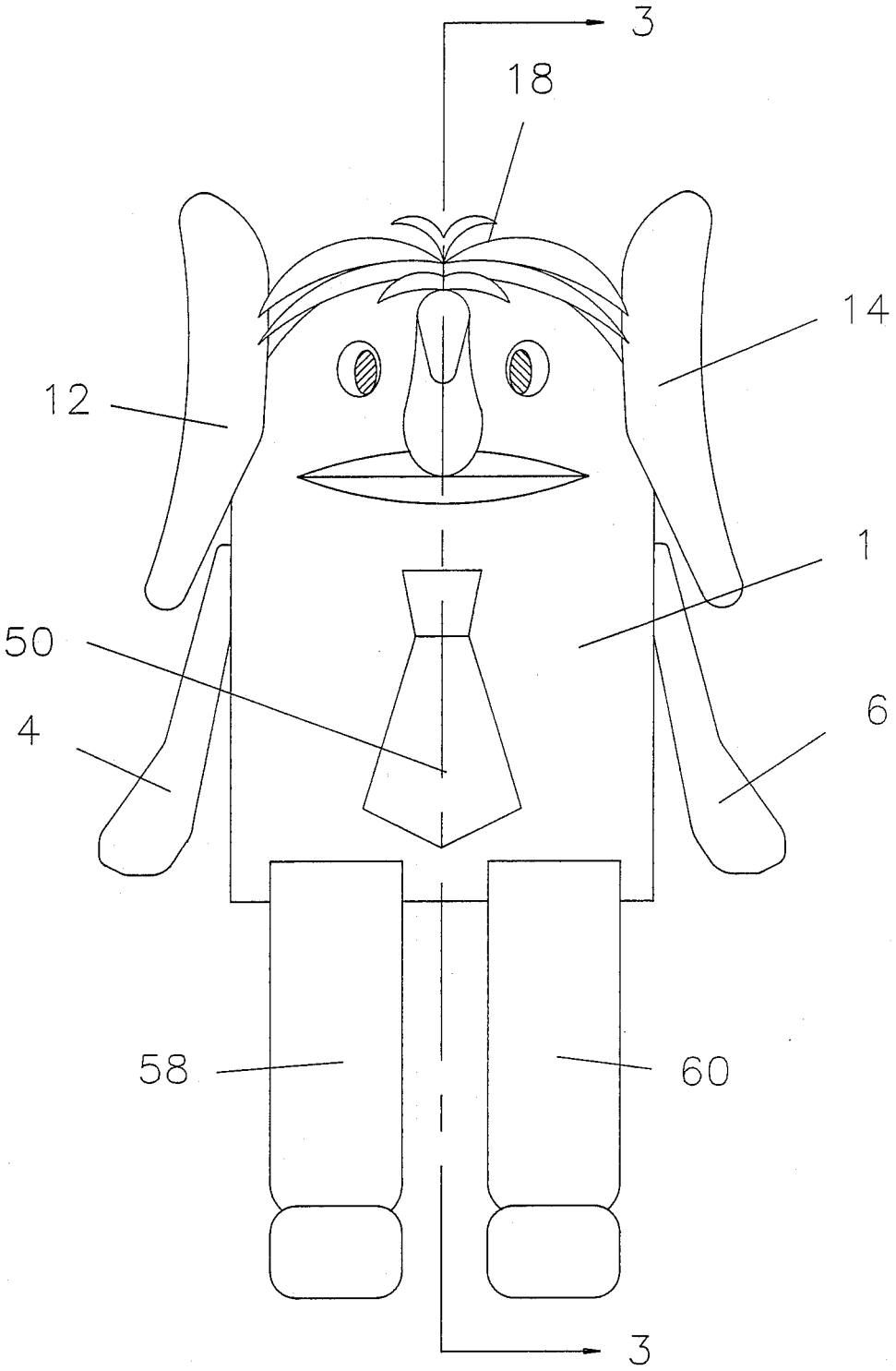
FIG. 2 illustrates a front view of the embodiment of FIG. 1.

In FIGS. 1 and 2 there is shown the basic preferred embodiment of the present invention in side and front views. The choice of character and the parts illustrated in the drawings are only meant to be representative and in no way are to be construed as a limitation to the possible characters and attachable parts available. The body 1 is in the preferred embodiment a unitized 3 dimensional structure consisting of the head, a moveable mouth structure, and a body sleeve fabricated from a "VELCRO"-like type loop fabric. "VELCRO" is a trademark of VELCRO USA, Inc. and signifies a hook and loop fastener system. There are other manufacturers of similar hook and loop type fabrics and fastener systems. In this discussion the "VELCRO" brand name is used to signify this class of material. The various basic body parts are attached to the body by the hook side of the "VELCRO"-like fastener. The arm 4 is attached to the body 1 with the hook fastener located at 8. Similarly the ear 12 is fastened to the body by the hook fastener at 15. The surface of the mouth 42 is fabricated from the same loop type "VELCRO"-like fabric and may be soft and formable or reinforced with a rigid material to give it shape and defined mobility. Items may be attached to the surface of the mouth using the hook type "VELCRO"-like material. These items may be body parts such as a tongue or items of food such as an ice cream cone or carrot. All elements such as the hair 18, nose 38, eye 30, and tie 50 may be affixed to the body 1 using hook type fasteners located at 22, 34, 26, and 46. This hook fastener is affixed to the attachable element in an appropriate method such as but not limited to sewing, gluing, and snap fitting. It will be recognized by those skilled in the art that the hook and loop materials could be reversed and achieve a similar result.

In normal usage the user constructs a puppet character from the available parts. The user may select from a wide variety of eyes, noses, clothes, leg and arm shapes, wings, other appendages, and accessories. These characters may be changed at will by detaching elements and attaching others. Because the body and face 1 is substantially constructed from "VELCRO"-like loop fabric, parts may be attached anywhere on its surface. This is generally true of most other elements thereby allowing greater flexibility for creative play through stacking elements.

Figure 3:
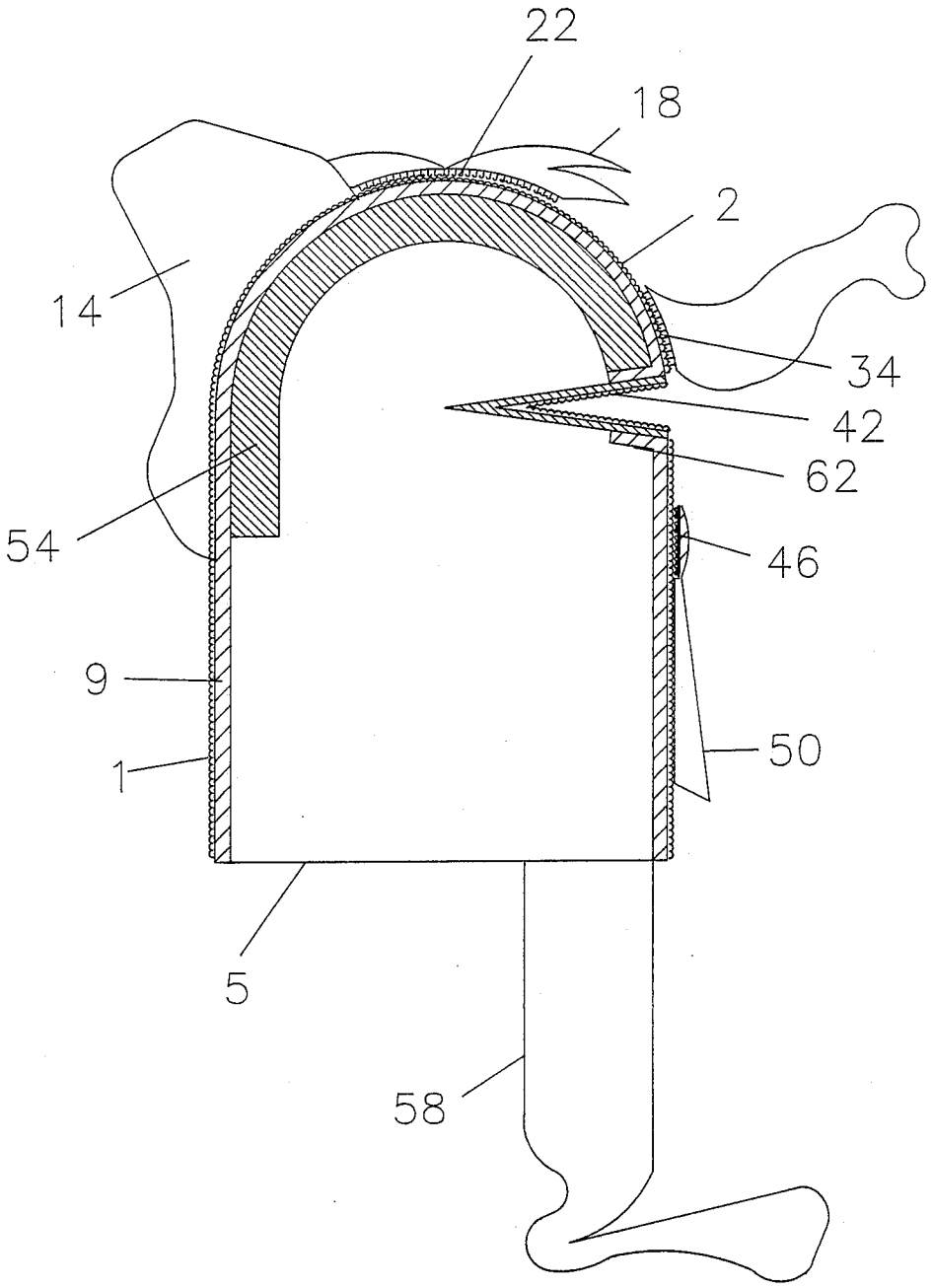
FIG. 3 is a sectional side view of the preferred embodiment of the present invention which shows the internal structure and the means of attachment of the individual modular parts.
Figure 4:
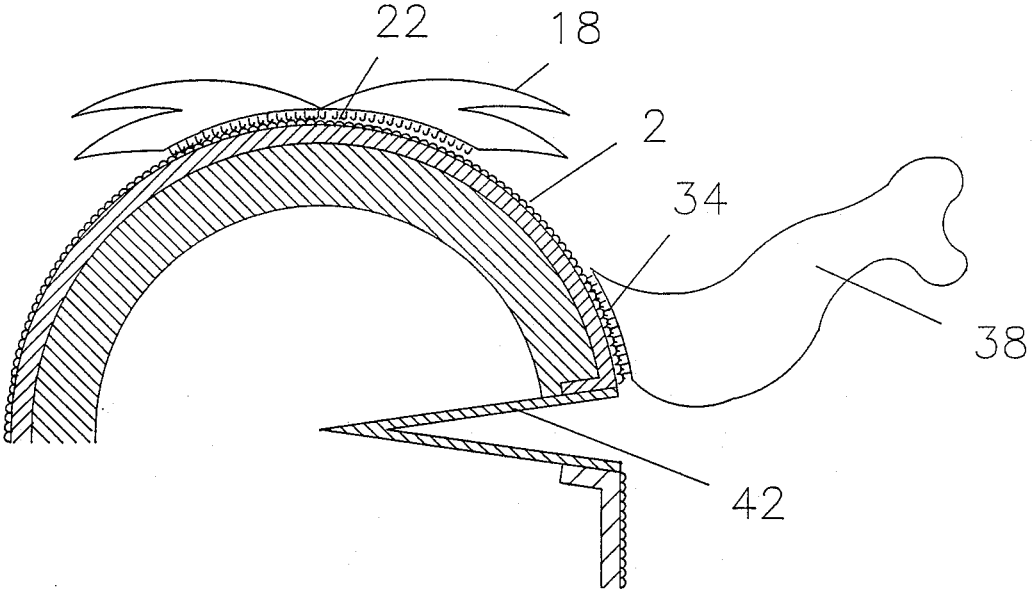
FIG. 4 is an enlarged partial sectional side view of the preferred embodiment showing the method of modular attachment and the preferred method of construction of the mouth.
Figure 12:
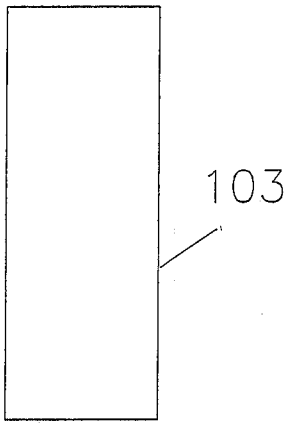
FIG. 12 is the front view of FIG. 11.
Figure 11:
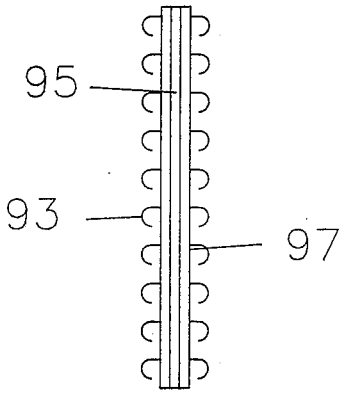
FIG. 11 is a side view of a back to back hook type fastener which is used to attach two loop type components together.

FIG. 3 depicts a side section view of the preferred embodiment and FIG. 4 shows an enlarged section of a portion of the head to provide greater clarity in showing the method of attachment of elements. The section views show the location of the hook type fasteners used to attach various elements to the body and head 1. In the case of a hand puppet, the body 1 has a hollow cavity 5 which allows the user to place their hand within the body to manipulate the "VELCRO"-like coated mouth 42 and other such moveable extremities to which access is provided. The surface of the body is covered with loops of filament to allow the hook to attach. In the preferred embodiment the "VELCRO"-like fabric is a laminated material with a loop outside surface 2, a foam core 9 to add stiffness and a jersey lining to protect the foam core. This material may be purchased from a number of commercial sources. Optionally to enhance the shape and rigidity of the puppet it may be additionally lined and filled 54 with a polyester fibre filling, urethane foam, or any other such suitable material. The hair 18 is fastened to the body 1 by "VELCRO"-like hook 22. The "VELCRO"-like hook may be permanently attached as in the case of the hair 18 which is not generally made from loop type fabric. The ear 14, however may be constructed from loop type fabric and thereby may have the "VELCRO"-like hook permanently attached or optionally a double sided fastener constructed from hook type fabric permanently fastened or bonded back to back as shown in FIGS. 11 and 12 may be used. The use of this item will be explained in more detail later.

The mouth may be constructed to be either hard or soft through the addition of stiffening material in its construction. The mouth 42 is attached to the body 1 with flaps 62 at the top and bottom lips. This attachment may be accomplished through sewing, bonding, or snap fits. It is, however, not limited to these methodologies.

Figure 5:
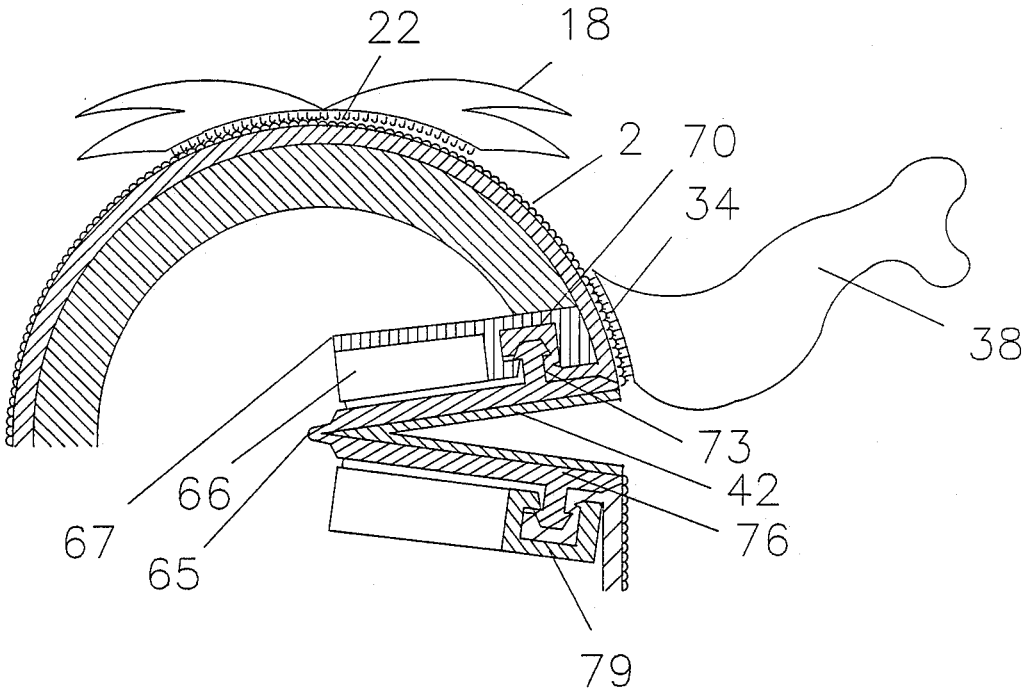
FIG. 5 is an enlarged partial sectional side view of an alternate embodiment showing the method of modular attachment and a snap together method of construction of the mouth.

FIG. 5 shows an alternate method of construction for the mouth. In this technique the mouth is fabricated from 3 molded parts. The hingeable mouth 76 is molded from polypropylene or other suitable plastic that can provide a thin flexible living hinge 65. It also includes 2 dart type projections 73 which extend circumferentially around the lip. The dart traps and locks a flap of fabric extended from the body 1. This locking is accomplished by snapping the upper retainer 67 and lower retainer 79 over the flap of fabric 70 and dart 73. Item 67, the upper retainer, may advantageously be molded with a cavity 66 for insertion of the fingers to facilitate movement of the mouth. The "VELCRO"-like loop fabric may be bonded to the surface of the hingeable mouth 76 using contact adhesive, double sided tape, or attached by mechanical means such as sewing.

Figure 7:
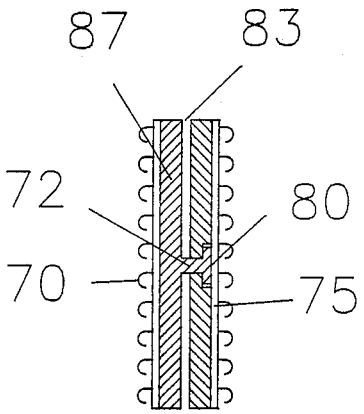
FIG. 7 is a side sectional view of FIG. 6.
Figure 6:
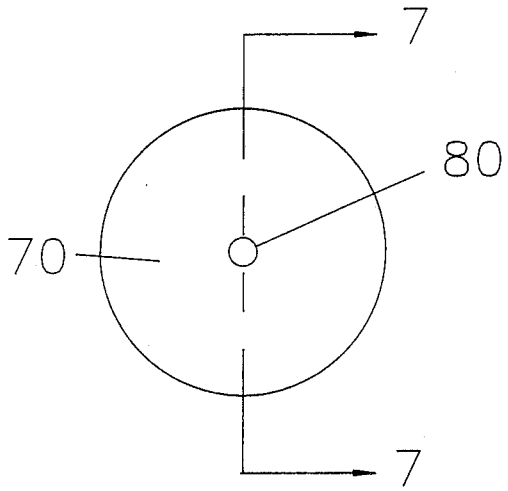
FIG. 6 is the front view of the preferred embodiment of a pivot device to attach moveable extremities and control elements to each other.
Figure 9:
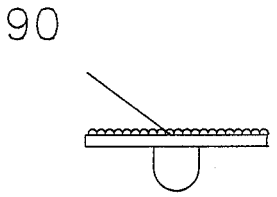
FIG. 9 is the top view of FIG. 8.
Figure 8:
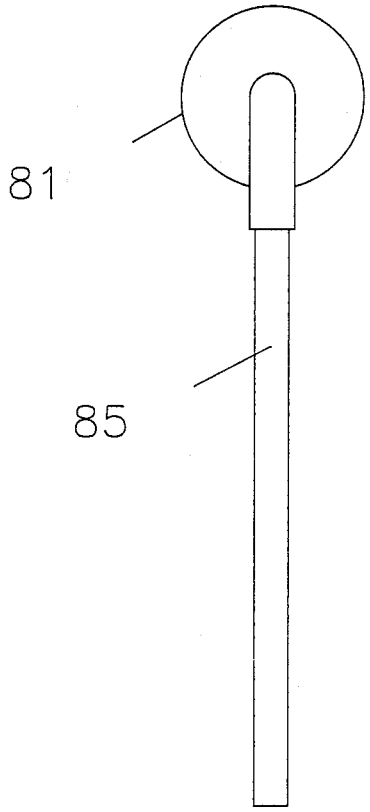
FIG. 8 is the front view of the preferred embodiment of a push rod element.
Figure 10:
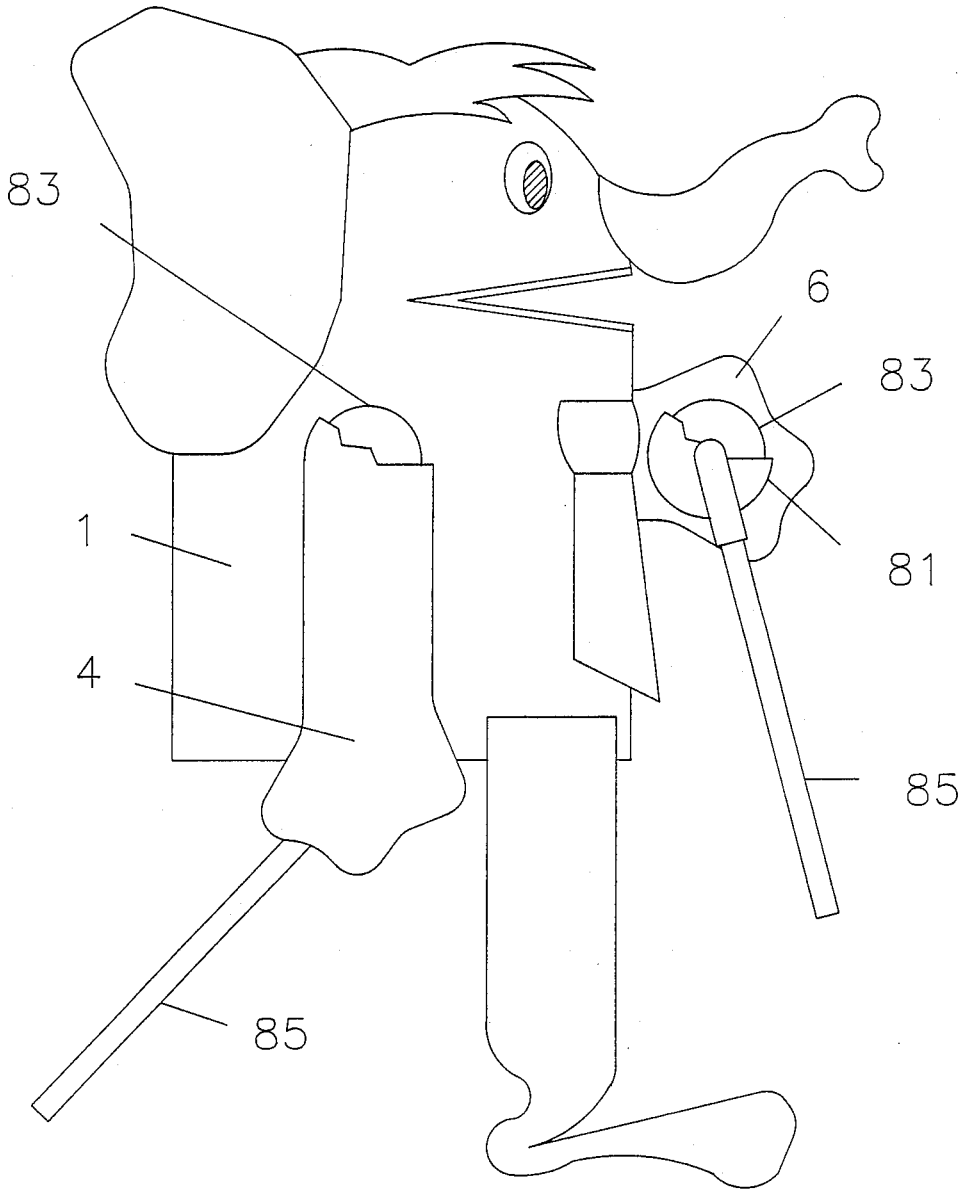
FIG. 10 is a side view showing the preferred embodiment of FIG. 1 with the addition of the push rod controls of FIG. 8 and FIG. 9 and the pivot device of FIG. 6 and FIG. 7.

The present invention may be converted to more advanced forms of puppet through the addition of moveable modular features and control elements. FIGS. 6 and 7 illustrate the construction of one such moveable connection member. This device is constructed from 2 plates which pivot about their center with relation to one another. In the preferred embodiment, the plates are injection molded. The fixed plate 87, is molded with a post 72 that acts as the pivot point for the rotatable plate 75. The post 72 may be headed over by heat, ultrasonics, spinning, or other suitable means. It may also be advantageously designed as a snap fit. Each plate has a permanently attached "VELCRO"-like hook surface. An example of the use of this device is shown in FIG. 10 where the pivot 83 is placed between the arm 4 and the body 1. It is additionally used to provide an articulate means for controls such as the push rod illustrated in FIGS. 8 and 9, when placed between the attachment plate 81 and the arm 6. The use of this device at the shoulder as a pivot and on the surface of the push rod allows free motion of the arm. In a likewise manner the pivot could be used to attach other items in which a pivoting motion is desired. It will be recognized by those skilled in the art that the pivot and push rod could be combined as a single specialized control element.

FIG. 10 shows a side view of a hand puppet with push rods to lift and move the arms. In a likewise fashion, the push rod could be used to rotate the ear or any other attachment.

FIGS. 11 and 12 depict an attachment means for fastening two elements which are constructed from loop type material or which have partial surfaces of loop type material. This device allows wide flexibility in locating the points of attachment when interfacing between two such loop covered items and eliminates the need to permanently affix the hook type material to the element thereby additionally providing for improved manufacturing economies. It is constructed by permanently fastening 2 hook type fasteners back to back. This may be accomplished by bonding, fusing, or mechanically fastening such as sewing or by any other appropriate means. Multiple fasteners can be used if necessary to affix heavier items or provide multiple points of support. The outside shape of this device is not limited to the rectangular shape shown in FIGS. 11 and 12.

Figure 13:
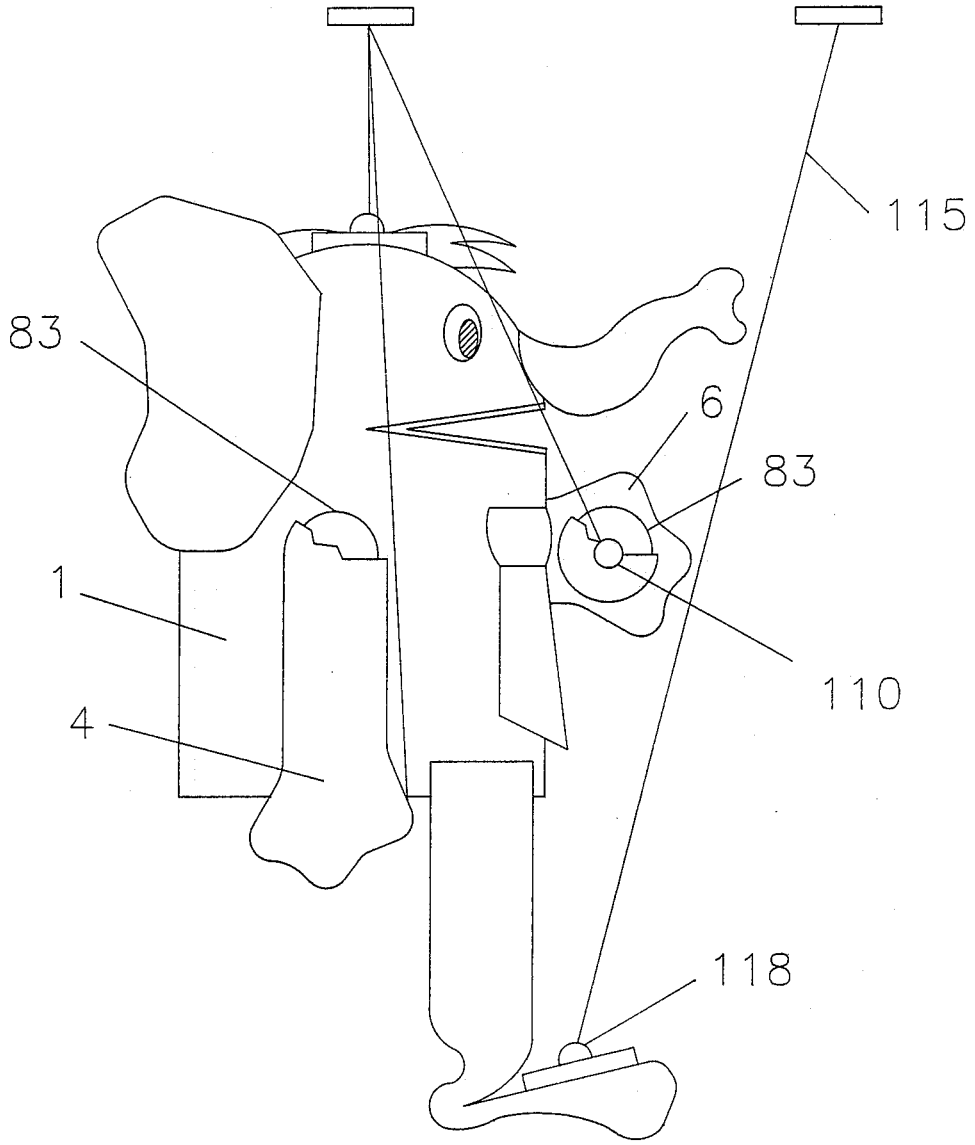
FIG. 13 is a side view showing the preferred embodiment of FIG. 1 with the addition of string controls.

FIG. 13 shows a side view of a puppet configured as a marionette. Attachment plates 118 have hook type "VELCRO"-like materials on one side and an eye or attachment means on the opposing side for a control string. These plates are normally positioned on the hands, legs, and on the head to support the puppet, but may also be attached to such other points as may be desired. The other end of the strings are attached to control bars 112. The movement of the control bars allows the lifting of arms and legs or any other element to which they are attached. Additionally, it is possible to combine control systems and use a combination of string and hand puppet controls.

Figure 14:
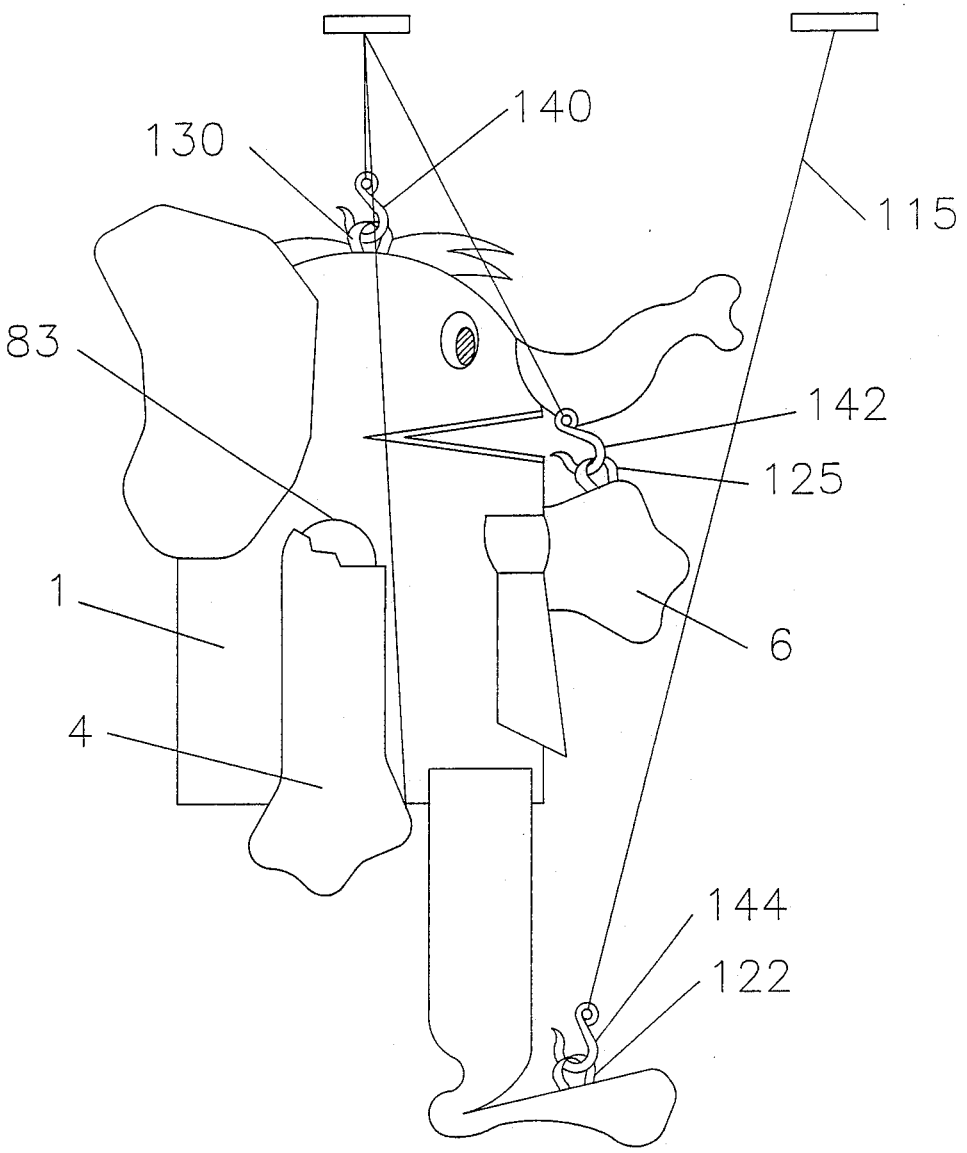
FIG. 14 is a side view showing an alternate embodiment of FIG. 1 with the addition of string controls using hooks attached to the loops which are a part of the element under control.

FIG. 14 shows an alternative means to attach strings to the puppet by providing a loop of material 122, 125, 130 permanently affixed as an attachment point on each controllable element. This loop will provide a means of attachment for a hook 140, 142, 144 or similar device to slip into the loop with a place to attach the string at the hook. This means may be used particularly when support of a heavy element is required.

As will be apparent to persons skilled in the art, various modifications, adaptations and variations of the foregoing specific disclosure can be made without departing from the teaching of this invention.

Having thus described this invention, what is claimed is:

1. A modular hand puppet non-destructively convertible into different characters and forms of operation, comprising a three dimensional unitized head with a mouth and a body; an outer surface of said unitized head, mouth surface, and body comprises a loop type fabric for the purpose of placing a plurality of detachable facial features, flexible body extremities, clothing and accessories anywhere on said loop surface; the body being a unitized structure including a cavity into the head for receiving a hand to support the puppet and operate the mouth which has an upper surface and an opposing lower surface to both consist of a loop type fabric capable of engaging a plurality of attachable features and accessories; said features, clothing, and accessories to have a permanently attached hook type fastener for engagement anywhere with the loop type surfaces of the body, mouth, head, and extremites; said flexible body extremities to have at least one loop type fabric surface to releasably attach a pivoted fastener element between the flexible body extremity and the body; said pivoted fastener element comprises two plates with an axle pivotally attaching each plate to the other and each plate further including a hook type material; said loop type surfaces of the body, flexible body extremities, and accessories to allow a multiplicity of removals and attachments to said loop surfaces without destruction of said loop type surface; said loop type surfaces on the body, flexible extremities, and other elements to be receptive to the attachment of a control device.

2. The puppet of claim 1 which uses the pivoted fastener element as an intermediate pivotable means of attachment of a push rod type control element to a controllable body extremity appendage; said pivoted fastener element when placed between attachable items with at least one loop type surface such as the body, body extremities, controls, and other elements allow the attachable items to adhere to each other without benefit of permanent attachment of the hook material to either one and each such attachable item to pivot with respect to one another; said push rod type control element to be constructed of a flat plate and an affixed rod, with a plane of said flat plate to be parallel to an axis of the affixed rod; said assembled push rod to have the flat plate surface opposed to the affixed rod covered with a loop material; said pivot device to allow articulate movement between the push rod control and the assembled puppet.

3. The puppet of claim 1 in combination with a string control device to non-permanently convert the hand puppet for use as a marionette; said string control device to contain a hand held control element consisting of a handle and a cross bar; said string control device has one end of a plurality of strings fabricated from a string-like material afixed to the cross bar and handle, and a far end of each of said strings is attached to a button attachment device; said button attachment device allows said strings to be attached non-destructively to the puppet body, flexible body extremities, and accessories; said button attachment device to be a plate with hook material on one surface and a means of attachment of a string on the opposed surface; said string control device allows the hand puppet to be converted to a string controlled marionette through the placement of said button attachment devices on the loop surface of the head and body extremities such as the arms, legs, and other appendages; said string control device to act as a support and motion control for said marionette.

4. The puppet of claim 1 which implements a moveable mouth by means of a molded snap together assembly; said mouth is formed by a hingeable plate to allow an upper and a lower surface to hingeably articulate, a dart shaped projection cicumferential to an upper and a lower lip to aid in anchoring the body fabric, and an upper and a lower clamp device to anchor fabric to said circumferential dart by means of trapping the fabric between the circumferential darts and a circumferential latching pocket; said circumferential latching pocket to be an integral part of the upper and lower clamp devices; said clamp devices to have a pocket for receiving the fingers to aid in control of the mouth.

5. A modular hand puppet non-destructively convertible into different characters and forms of operation, comprising a three dimensional unitized head with a mouth and a body; an outer surface of said unitized head, mouth surface, and body comprises a loop type fabric for the purpose of placing a plurality of detachable facial features, flexible body extremities, clothing and accessories anywhere on said loop surface; the body being a unitized structure including a cavity into the head for receiving a hand to support the puppet and operate the mouth which has an upper surface and an opposing lower surface to both consist of a loop type fabric capable of engaging a plurality of attachable features and accessories; said flexible body extremities to have at least one loop type fabric surface to releasably attach a pivoted fastener element between the flexible body extremity and the body; said pivoted fastener element comprises two plates with an axle pivotaly attaching each plate to the other and each plate further including a hook type material; said modular hand puppet used in combination with a stand alone hook-hook type fastener with hooks on both sides as an intermediate device to non-permanently attach an appendable element fabricated with a loop type outer surface to the body, and other such loop type fabric covered flexible body extremities and accesories; said fastener consists of two pieces of hook type material permanently fastened back to back such as to form the stand alone hook-hook type fastener; said features, clothing, flexible extremities, and accessories when comprised of a variety of materials to have a permanently attached hook type fastener for engagement anywhere with the loop type surfaces of the body, mouth, head, and other extremites; said loop type surfaces of the body, flexible body extremities, and accessories to allow a multiplicity of removals and attachments to said loop surfaces without destruction of said loop type surface; said loop type surfaces on the body, flexible extremities, and other elements to be receptive to the attachment of a control device.

6. The puppet of claim 5 which uses the pivoted fastener element as an intermediate pivotable means of attachment of a push rod type control element to a controllable body extremity appendage; said pivoted fastener element when placed between attachable items with at least one loop type surface such as the body, body extremities, controls, and other elements allow the attachable items to adhere to each other without benefit of permanent attachment of the hook material to either one and each such attachable item to pivot with respect to one another; said push rod type control element to be constructed of a flat plate and an affixed rod, with a plane of said flat plate to be parallel to an axis of the affixed rod; said assembled push rod to have the flat plate surface opposed to the affixed rod covered with a loop material; said pivot device to allow articulate movement between the push rod control and the assembled puppet.

7. The puppet of claim 5 in combination with a string control device to non-permanently convert the hand puppet for use as a marionette; said string control device to contain a hand held control element consisting of a handle and a cross bar; said string control device has one end of a plurality of strings fabricated from a string-like material afixed to the cross bar and handle, and a far end of each of said strings is attached to a button attachment device; said button attachment device allows said strings to be attached non-destructively to the puppet body, flexible body extremities, and accessories; said button attachment device to be a plate with hook material on one surface and a means of attachment of a string on the opposed surface; said string control device allows the hand puppet to be converted to a string controlled marionette through the placement of said button attachment devices on the loop surface of the head and body extremities such as the arms, legs, and other appendages; said string control device to act as a support and motion control for said marionette.

8. The puppet of claim 5 in combination with a string control device to non-permanently convert the hand puppet for use as a marionette; said hand puppet has a loop permanently affixed to a controllable or supportable element to provide a means of attachment for a hook to which a string-like material is attached; said string control device has one end of a plurality of strings attached to a cross bar and handle and a far end of each of said strings attached to a hook; said hooks provide a means to non-permanently attach strings to the loops of the controllable or supportable element; said control allows the hand puppet to be converted to a string controlled marionette through the placement of said strings and hooks into the loops on the controllable or supportable elements such as the head, arms, legs, and other appendages.

* * * * *